US005323577A

United States Patent [19]

Whitmyer

[11] Patent Number: 5,323,577

[45] Date of Patent: Jun. 28, 1994

[54] ADJUSTABLE PANEL MOUNTING CLIP

[75] Inventor: Wayne E. Whitmyer, Lilburn, Ga.

[73] Assignee: Kawneer Company, Inc.

[21] Appl. No.: 882,570

[22] Filed: May 13, 1992

[51] Int. Cl.[5] ..... E04B 2/88

[52] U.S. Cl. ..... 52/235; 52/741.1; 52/209

[58] Field of Search ..... 52/235, 209, 208, 403, 52/404, 407, 58, 60, 489, 741.1, 589, 202, 204.62, 506; 248/222.1, 221.2, 220.2, 220.4, 222.4, 225.1

[56] References Cited

U.S. PATENT DOCUMENTS

| | | | |
|---|---|---|---|
| 2,313,779 | 11/1959 | Hedgren | 52/204.62 |
| 3,176,806 | 4/1965 | Ferrell | 52/209 |
| 4,009,549 | 3/1977 | Hala | 52/506 |
| 4,266,386 | 5/1981 | Bains | 52/589 |
| 4,483,122 | 11/1984 | Crandell | 52/235 |
| 4,557,088 | 12/1985 | Kaminaga | 52/235 |
| 4,571,905 | 2/1986 | Kaminaga | 52/235 |
| 4,611,447 | 9/1986 | Krechel | 52/209 |
| 4,662,135 | 5/9187 | Tamikawa et al. | 52/235 |
| 4,811,537 | 3/1989 | D'Epenoux | 52/235 |
| 4,979,344 | 12/1990 | Kusunoki | 52/235 |
| 5,067,300 | 11/1991 | Takeda | 52/235 |

FOREIGN PATENT DOCUMENTS

| | | | |
|---|---|---|---|
| 2905238 | 8/1980 | Fed. Rep. of Germany | 52/235 |
| 2139686 | 11/1984 | United Kingdom | 52/202 |

*Primary Examiner*—Carl D. Friedman
*Assistant Examiner*—Winnie Yip
*Attorney, Agent, or Firm*—Jones & Askew

[57] ABSTRACT

A mullion framework provides an improved configuration for mounting solid and glass panels, which is effective in mounting panels abutting fixed sills and headers. An improved universal bracket is also provided which allows for panel expansion or contractions due to thermal cycling. The brackets allow for an improved assembly method for installing solid panels underneath headers.

3 Claims, 8 Drawing Sheets

ADJUSTABLE PANEL MOUNTING CLIP

TECHNICAL FIELD

This invention relates in general to building construction systems and more particularly to curtainwall framing systems for office or other commercial buildings.

BACKGROUND OF THE INVENTION

In commercial building constructions, such as office buildings, high rise apartment buildings, hotels, and the like, solid panel members are typically used in conjunction with glass panel units in a curtainwall environment. However, as these planar shaped panels tend to expand and contract due to thermal cycling, needs always exist to accommodate such size variation while maintaining sufficient weatherproofing between the panels. Needs also exist for panels which may be installed easily and reliably by even the least skilled.

SUMMARY OF THE INVENTION

The present invention overcomes deficiencies in the prior art by providing a curtainwall framing system which accommodates size variation of panel members in two directions due to thermal cycling. The present invention also is directed toward the use of a "universal" bracket which may be used in a variety of applications.

Therefore, it is an object of the present invention to provide an improved curtainwall framing system.

It is a further object of the present invention to provide an improved curtainwall framing system which includes improved adjusting features.

It is a further object of the present invention to provide a curtainwall framing system, in which panels positioned under a header may be easily and readily installed.

It is a further object of the present invention to provide an improved bracket for mounting panels to a framing system in a curtainwall environment.

It is a further object of the present invention to provide a bracket for use in a curtainwall framing system, which is of a "universal" nature, not being right- or left-handed.

It is a further object of the present invention to provide a bracket for use in a curtainwall framing system, which may be initially adjusted, and finally secured in a set position after adjustment.

It is a further object of the present invention to provide a curtainwall framing system which accommodates vertical and horizontal expansion of panel members attached thereto.

Other objects, features, and advantages of the present invention will become apparent upon reading the following detailed description of the preferred embodiment of the invention when taken in conjunction with the drawings and the appended claims.

DETAILED DESCRIPTION OF THE PREFERRED EMBODIMENT

General Layout

Figure 1:
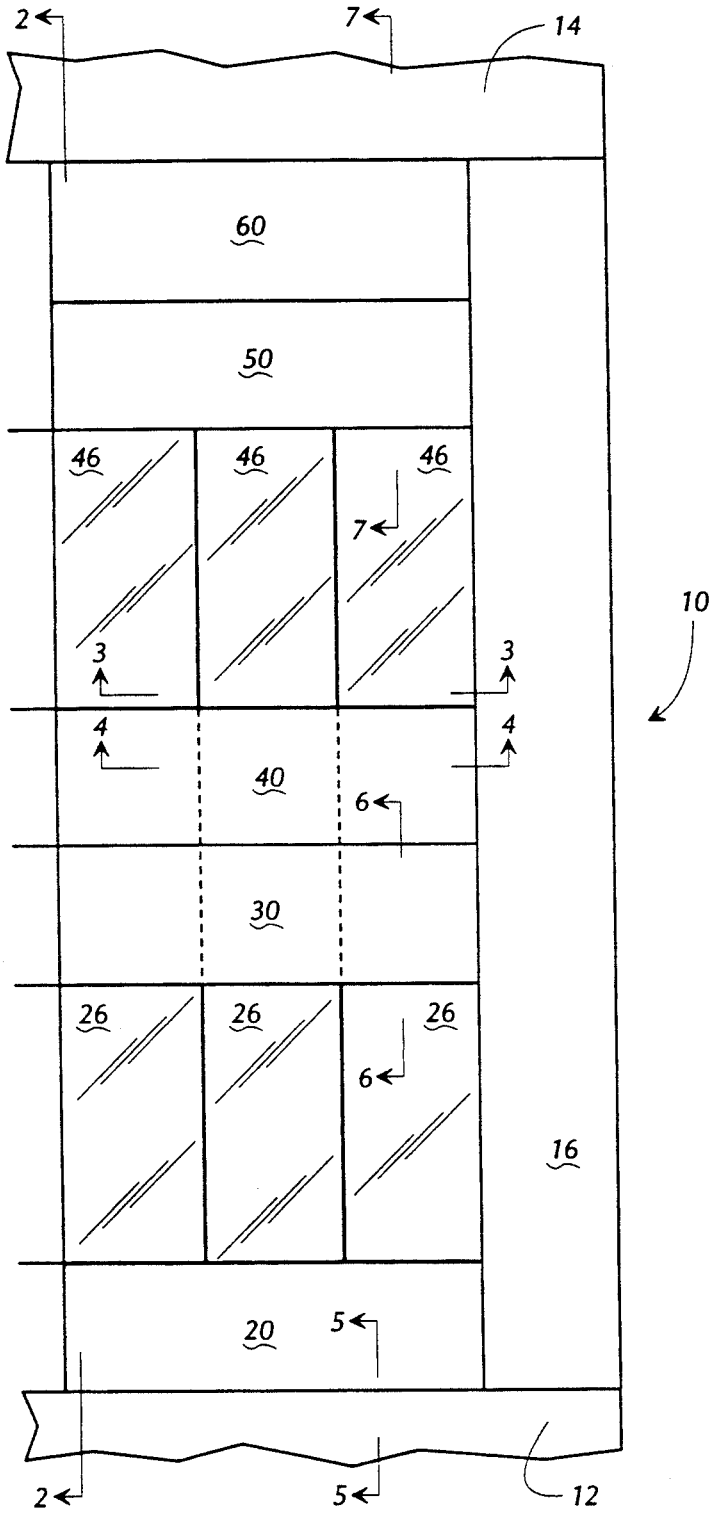
FIG. 1 is a fragmentary front view of the external wall of a building on which planar-shaped panel members are attached to a building by brackets according to the present invention.

Referring now to the drawings, in which like numerals designate like elements throughout the several views, FIG. 1 illustrates a portion of a building 10 including a sill portion 12, a header portion 14, and a comer portion 16. Positioned above the sill portion 12, among other elements, is a detachable solid panel unit 20. Positioned above the panel unit 20 are a plurality of detachable glass panels 26. Positioned above the plurality of glass panel units 26 is a detachable solid panel unit 30. Positioned above the solid panel unit 30 is another solid panel unit 40 which interlocks with panel unit 30 as described in detail below. Positioned above the panel unit 40 are a plurality of glass panel units 46. Positioned above the glass panel units 46 is a solid panel unit 50. Positioned above the solid panel units 50 is a solid panel unit 60 configured to interlock with unit 50 as described below. The comer portion extends from sill portion 12 to header portion 14.

Figure 2:
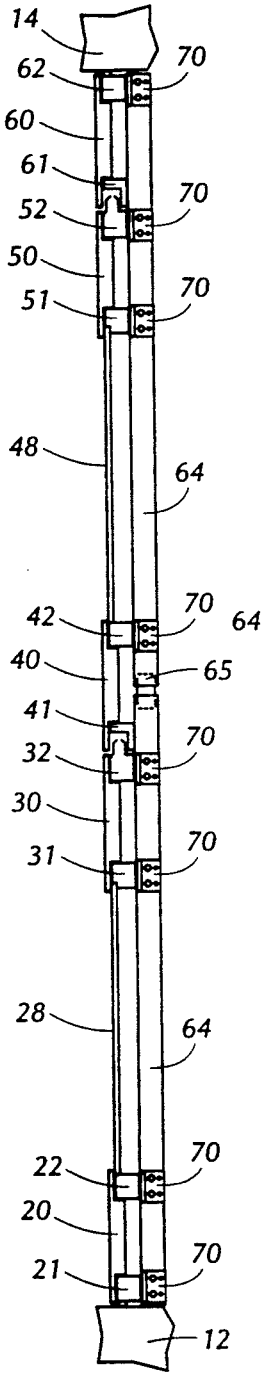
FIG. 2 is a side cross-sectional view of the portion of the building illustrated taken along line 2—2 of FIG. 1.

Referring now also to FIG. 2, the panel units 20, 30, 40, and 50 are each mounted to a mullion member 64 (as well as other mullions) by L-shaped brackets 70. The mullion members 64 may be spliced together at a splice junction 65.

It may be understood that the above combination of elements is only one of many combinations which may be achieved under the present invention. Other combinations may be achieved without departing from the spirit and scope of the present invention, which could include subcombinations or multiples of the elements identified above.

Specific Overall Layout

Figure 5:
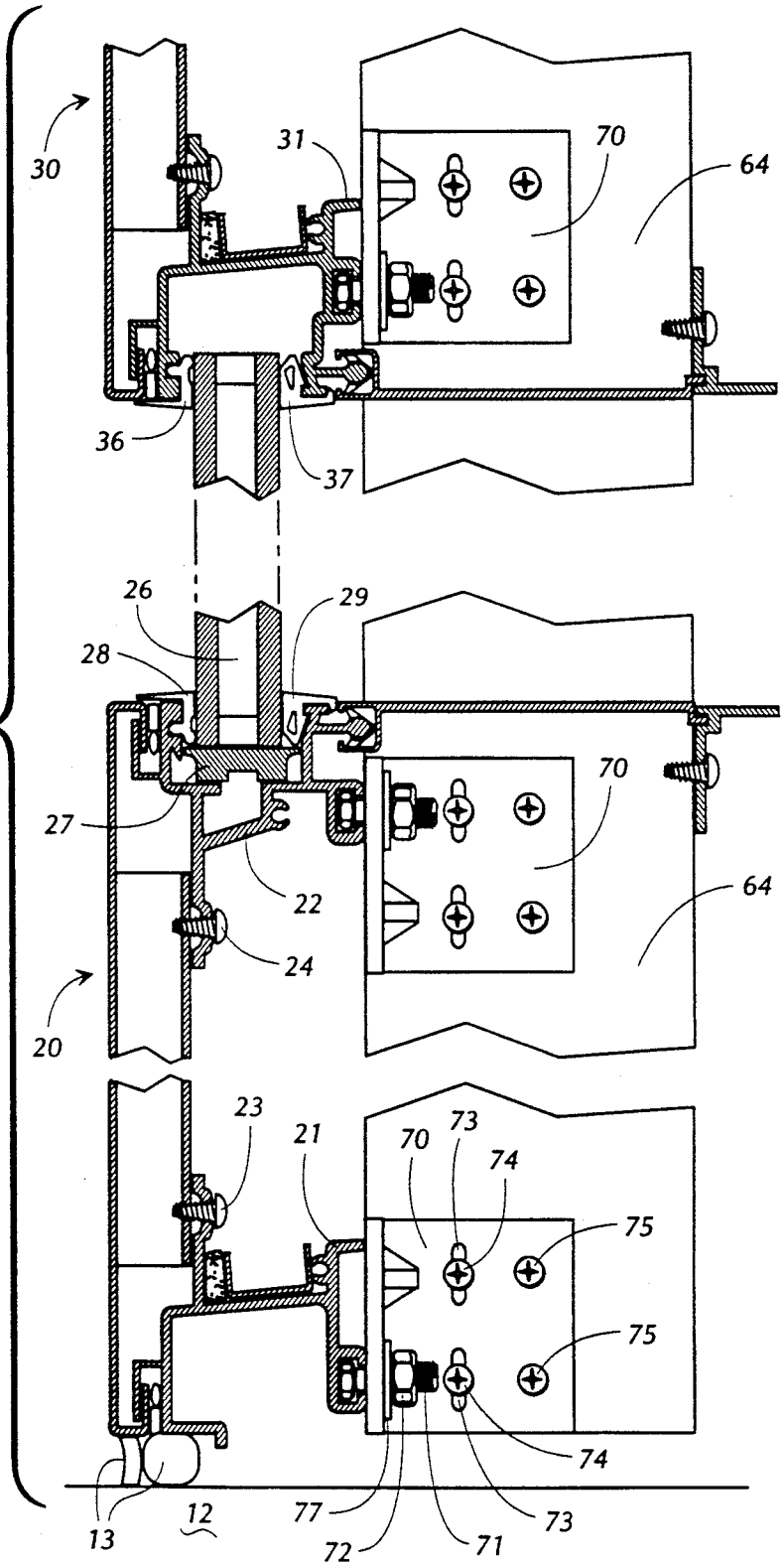
FIG. 5 is a cross-sectional view of a part of the curtainwall framing system according to the present invention taken along line 5—5 of FIG. 1.
Figure 6:
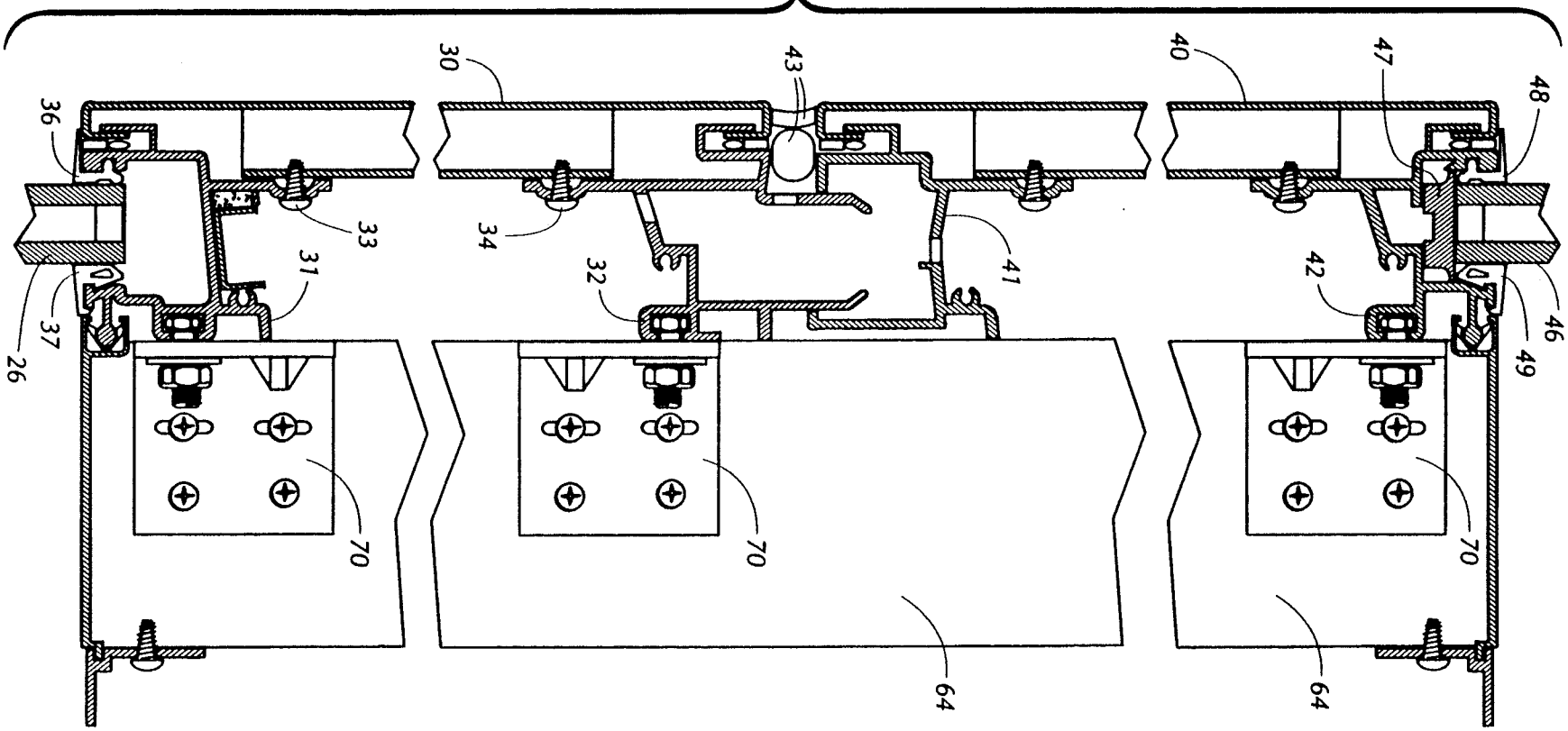
FIG. 6 is a cross-sectional view of a part of the curtainwall framing system according to the present invention taken along line 6—6 of FIG. 1.
Figure 7:
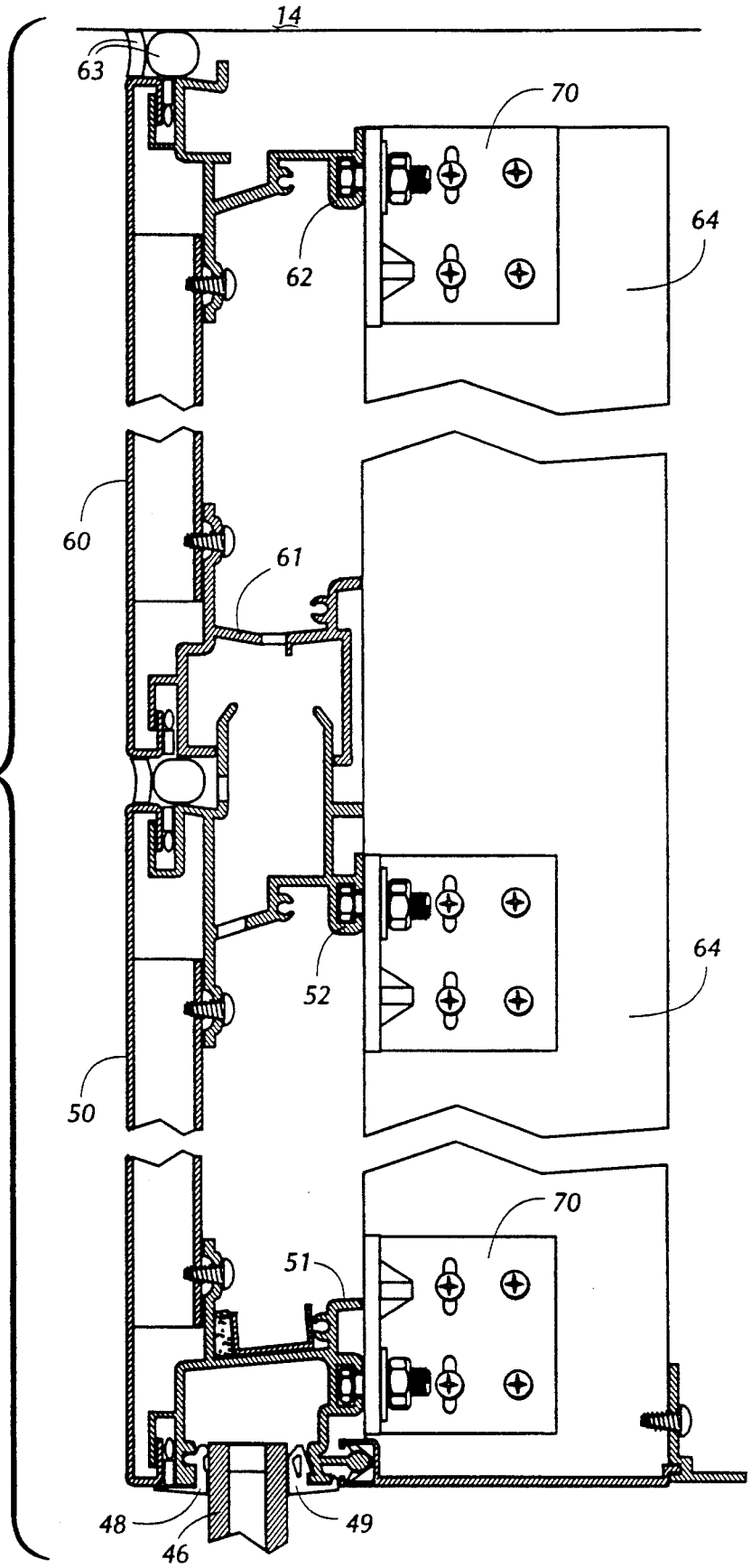
FIG. 7 is a cross-sectional view of a part of the curtainwall framing system according to the present invention taken along line 7—7 of FIG. 1.

Referring now to FIGS. 5–7, the interaction of the various elements described above is discussed in further detail. Reference is made to sill member 12, which is such as those known in the art, being made of concrete, steel, or the like. Positioned above the sill member 12 are typical weatherseals 13, such as those known in the art. Above the weatherseals are positioned the lowermost planar-shaped solid panel member 20.

The panel member 20 supports two elongate brackets thereon, lower bracket 21 attached to panel 20 by screws 23, and upper bracket 22, secured to panel 20 by self-tapping screws 24. Bracket 21 is attached to two brackets 70 by fastening assemblies comprised of a square-headed bolt 71 and a threaded nut 72. A lock washer 77 is also positioned between the nut 72 and the bracket 70. The head of the square-headed bolt 71 fits within a channel defined by the bracket 21, such that the head of the bolt 71 may slide relatively freely along the extruded length of the channel 21 prior to securement. The head of the bolt 71 cannot rotate when installed within the channel defined by the bracket 21. As discussed later in further detail, even after securement of bolt 71, the heads of the bolt 71 may also slide within the horizontally-oriented channel defined by the bracket 21, if the bracket (attached to a panel) expands or contracts horizontally due to thermal expansion and contraction.

Figure 13:
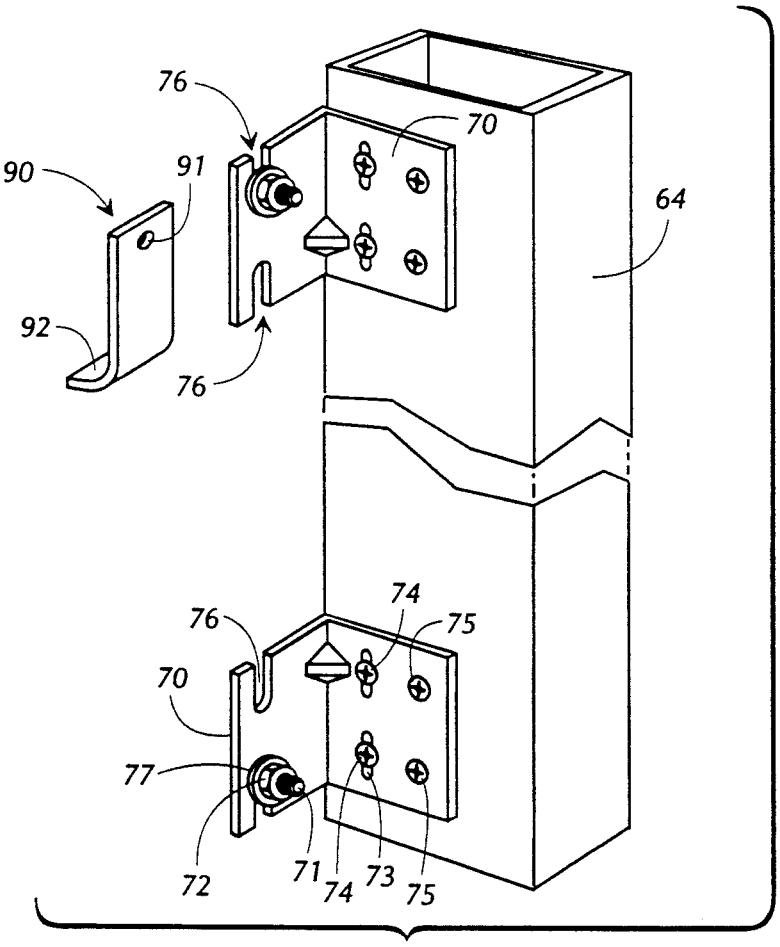
FIG. 13 is a isolated pictorial view of a portion of a mullion 64, having universal brackets 70 attached thereto. A portion of a threaded member 71 is also illustrated, showing the location of the two headed members when installed relative to the brackets 70. A limiting clip 90 is also illustrated, which may be used in conjunction with some of the brackets 70 in certain applications.
Figure 14:
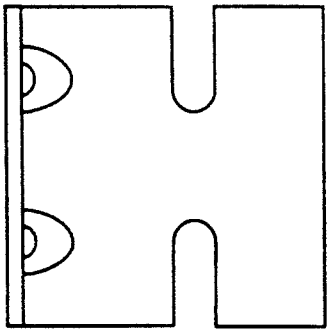
FIGS. 14–18 are alternative bracket configurations according to the present invention.
Figure 15:
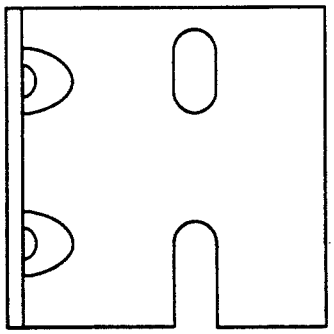
Figure 16:
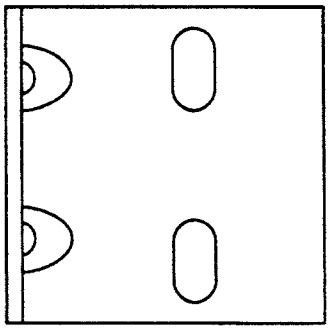
Figure 17:
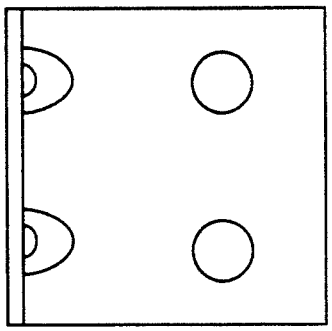
Figure 18:
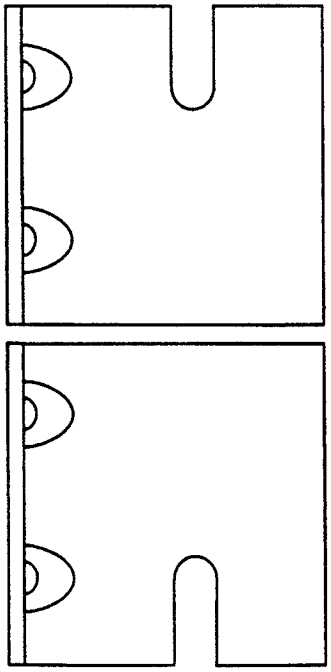

Referring now also to FIG. 13, the bracket 70 is attached to a typical mullion member 64, by a combination of screws 74 and 75. A pair of screws 74 fit within a corresponding pair of vertically-oriented slots 73 defined by one of the planar flanges of the brackets 70, such that, after loose attachment of the brackets 70 to the mullion 60 by screws self-tapping 74, the bracket may be adjusted upwardly or downwardly until its desired position is obtained, after which the screws 74 are tightened in place. Thereafter, screws 75, being self-drilling in the preferred embodiment, are inserted within a pair of holes defined by the brackets 70, after which they are drilled into place, thus fixing the location of the brackets 70 along to the mullion 64.

FIG. 13 also illustrates a "limiting clip" 90, which may be used in conjunction with some of the "upper" brackets 70 in certain applications, such as when only two "upper" brackets 70 are used to support the upper edge of panels 40, 60.

The upper elongate bracket 22 attached to the panel member 20 is likewise affixed to two corresponding brackets 70, which may be adjusted to relative to the mullion 64 as described above. The upper bracket 22 attached to panel member 20 not only provides interconnection between the panel 20 and the brackets 70, but also provides support for a glass panel unit 26, which is shown in FIG. 5 as being a "dual-pane" glass panel unit, such as those known in the art. The lower horizontal edge of the glass panel unit 26 shown in FIG. 5 is supported by a block 27, which is itself supported by the bracket 22. Typical front and rear seals 28, 29, respectively, are positioned to confront the front and rear faces, respectively, of the glass panel unit 26.

In discussing solid panel unit 30, reference is now made to FIGS. 5 and 6. Panel unit 30 is positioned above glass panel unit 26, and has lower and upper elongate brackets 31, 32, respectively, attached thereto. Such attachment is made by self-tapping screws 33, 34, respectively. These lower and upper brackets 31, 32, respectively are each attached to two universal brackets 70 in a manner similar to that discussed with respect to panel 20. The lower bracket 31 not only provides interconnection between panel member 30 and two brackets 70, but also contains the upper marginal edge of glass panel unit 26. Seals 36, 37 such as known the art are provided intermediate the glass panel unit 26 and the lower bracket 31.

The upper bracket 32 not only provides interconnection between panel unit 30 and two brackets 70, but also provides a male "mating" portion which is accepted by a female portion of lower bracket 41, which is attached along with upper bracket 42 to solid panel unit 40, also shown in FIG. 6. Seals 43 are provided intermediate panel units 30 and 40, such as known in the art.

It may be seen that upper elongate bracket 42 is attached to a mullion member 65 by two universal brackets 70, in a manner such as previously discussed. However, the lower bracket 41 does not, in the preferred embodiment, attach to a corresponding bracket, instead it "floats" relative to the male portion of bracket 32. Should the panel 40 expand or contract upwardly or downwardly, it may be understood that the bracket 41 may slide relative to the bracket 32. If the seals 43 can accommodate such expansion and contraction, an unbroken seal will be provided.

As described above, limiting clips 90 may be used in conjunction with the brackets 70 associated with the panel 40. These clips are not shown in place in FIG. 6 or 7, but may be inserted, if desired, as shown later in reference to FIGS. 10 and 11.

These clips 90 are used to prevent the bolts 71 associated with the panel 40 from creeping upward and out of the slots 76 of the brackets, which may occur due to the absence of lower brackets attached to the panels such as 20, 30. The clips 90 each include a hole 91 and an outturned flange 92. When in place, a bolt 71 extends through the hole 91, and the bolt 91 is prevented from excessive upward movement by the existence of flange 92, which contacts the lower edge of the associated bracket upon such upward movement.

Referring now to FIG. 6, the relative positioning of panel member 40 and glass panel unit 46 is now discussed. It may be understood that upper bracket 42 not only provides interconnection between panel member 40 and two brackets 70, but also provides support for the lower marginal edge of glass panel units 46, much in the same manner in which upper bracket 22 provides support for glass panel units 26. Once again, front and rear seals 48, 49, respectively, are used, as is a block 47.

Referring now to FIG. 7, the upper marginal edge of glass panel unit 46 is captured by lower elongate bracket 51, which is itself attached to solid panel unit 50 along with upper bracket 52. The lower elongate and upper brackets 51, 52, provide interconnection between the panel unit 50 and universal brackets 70. These brackets are attached to the mullion member 65 as previously discussed.

The solid panel unit 60 is attached to lower and upper brackets 61, 62, respectively. Upper bracket 62 is attached as discussed below to universal brackets 70 (themselves attached to a mullion 64), but the lower bracket 61 includes a female portion which accepts a male portion of bracket 52, much as were similar bracket portions discussed below. Limiting clips 90 may be used as described above to prevent upward creep due to thermal cycling. Sills 63 such as those known in the art are provided to provide weathertight seals between the upper edge of solid panel unit 60 and head member 14.

Figure 3:
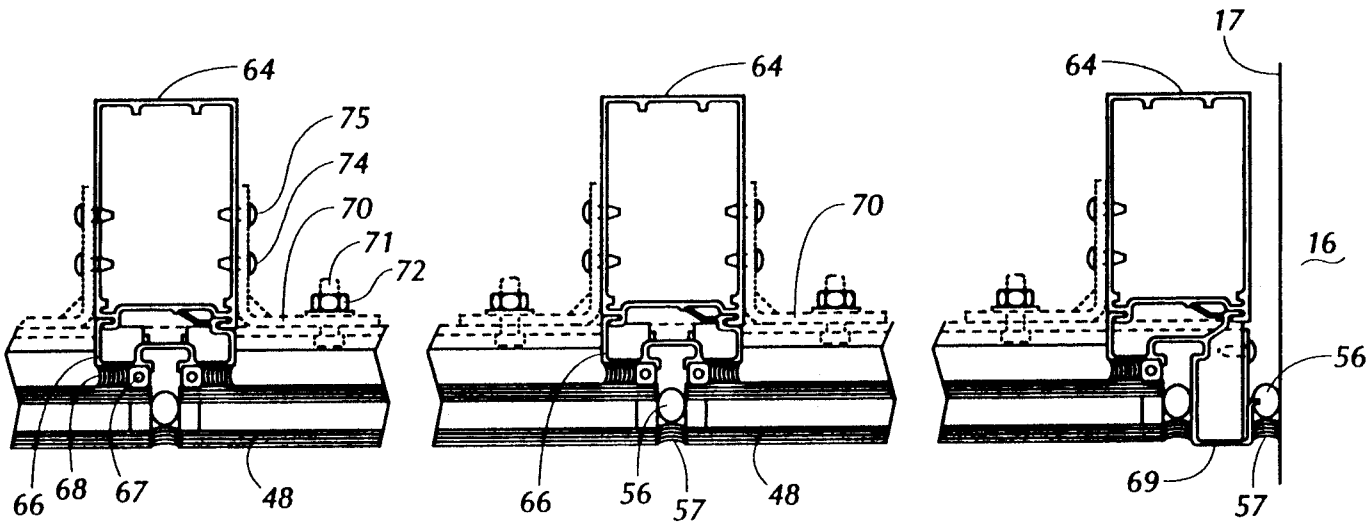
FIG. 3 is a cross-sectional view of a portion of the curtainwall system taken along line 3—3 of FIG. 1.

Referring now to FIG. 3, it may be seen that nosepieces 66 are used at the location where the vertical edges of adjacent glass panel units 48 abut. The nosepieces 66 are attached to the mullion 64, and spacers 67 and structural silicone 68 are provided to attach the marginal vertical edges of the glass panels 48 to the nosepieces. Spacers 56 and silicon 57 are used in the small gap intermediate the vertical edges of the glass panels 48. Spacer 56 and silicon 57 are also used intermediate a nose/edge piece 69 located adjacent to structural members 16.

Figure 4:
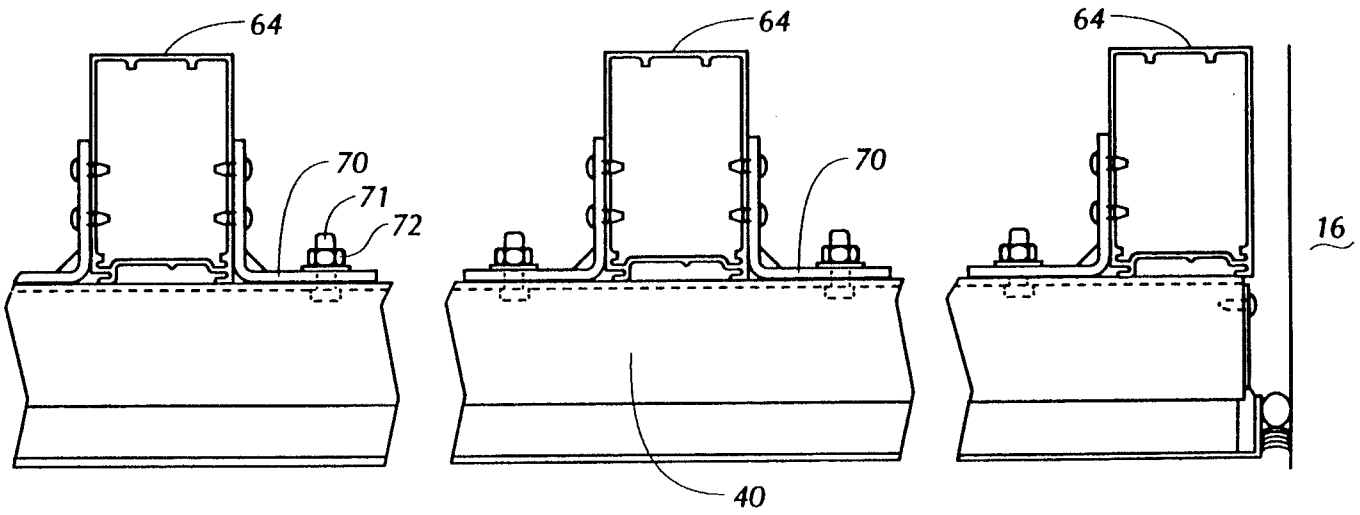
FIG. 4 is a cross-sectional view of the curtainwall framing system according to the present invention taken along line 4—4 of FIG. 1.

Referring now FIG. 4, it may be seen that nosepieces are not required when panel units such as 40 are attached to the mullion members 64.

In reference to the above elements, it may be understood that elements 21, 22, 31, 32, 41, 42, 51, 52, 61, 62, 64, 66, and 69 may be of extruded aluminum, although other configuration may be used without departing from the spirit and scope of the present invention.

Assembly

Figure 8:
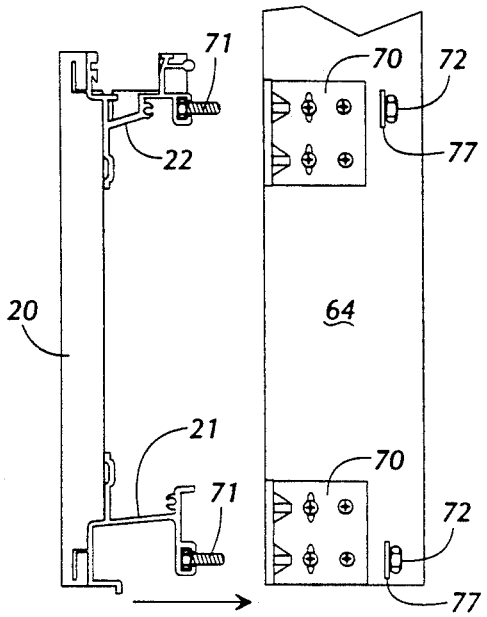
FIG. 8 is a side illustrative view illustrating the assembly direction of a panel member 20 relative to mullion 64.
Figure 9:
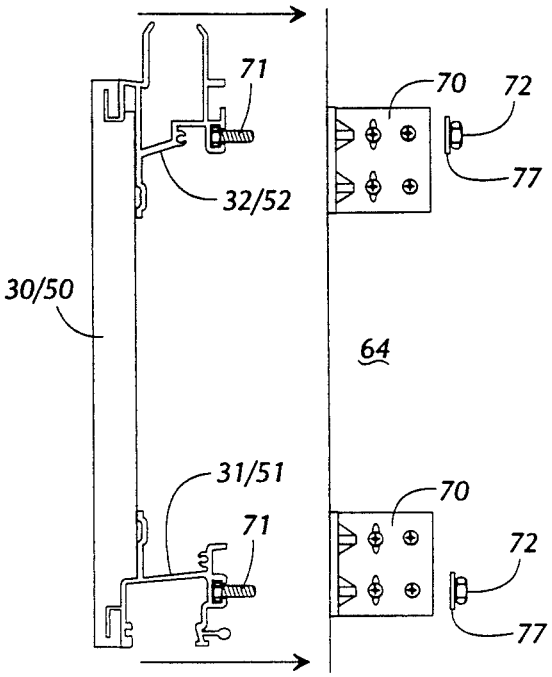
FIG. 9 is a side illustrative view illustrating the assembly direction of either of panels 30, 50, relative to a particular mullion 64.

Referring now also to FIGS. 8–11, the installation procedures for the above-referenced elements are now discussed. Preferably, the units are installed "from the bottom up", with lowermost members being installed first, and uppermost members being installed last. It may be noted that FIG. 9 illustrates the installation of panel member 30, as well as the installation of panel member 50.

Referring now to FIG. 8, panel member 20 is installed to mullion member 64 by inserting headed machine screws 71 into corresponding slots defined by brackets 70, and installing nuts 72 and washers 77. It may be understood that prior to installation of the nuts, the panel member 20 is "deadloaded" within the upper brackets, with the threaded fasteners 71 resting in the slots defined by the brackets.

Referring now to FIG. 9, panel member 30 is installed in a vertical fashion relative to the brackets 70, such that the upper headed machine screws 71 captured therein are "deadloaded" within the upwardly-directed slots defined by corresponding brackets 70, washers 77 and nuts are then installed.

Figure 10:
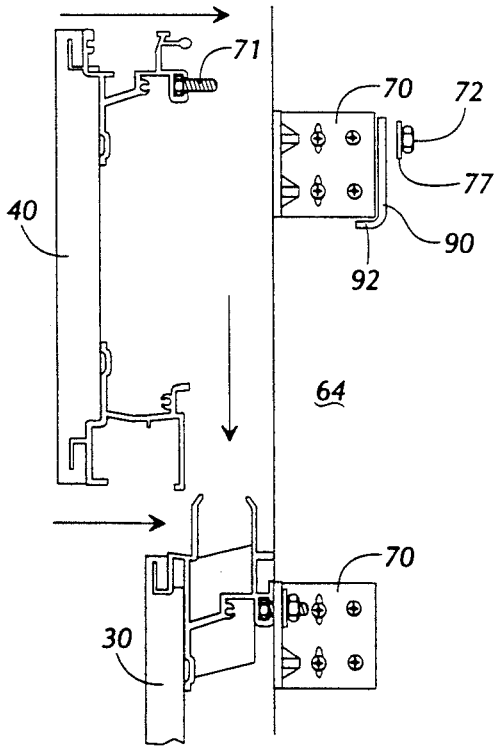
FIG. 10 is a side illustrative view illustrating the assembly direction of a panel member 40, relative to a panel member 30, and mullion 64.
Figure 11:
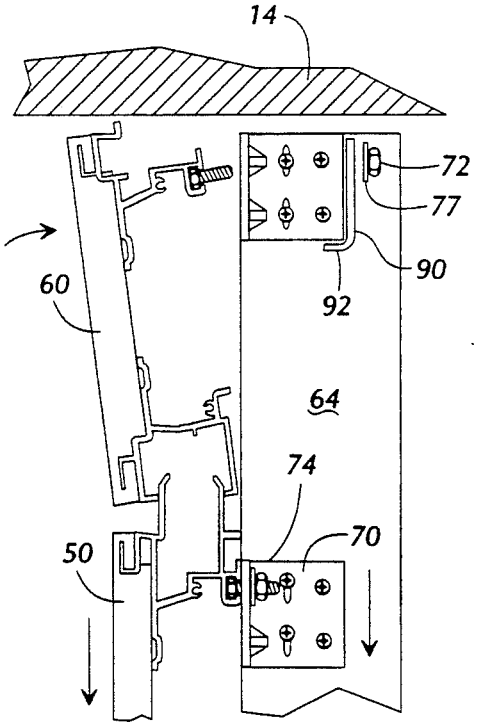
FIG. 11 is a side illustrative view illustrating the assembly direction of panel member 60, relative to a panel member 50 and mullion 64.

Referring now to FIG. 10, panel 40 is installed by first moving it in a horizontal direction towards the mullion members 64, and then moving it downwardly, such that the female portion of lower bracket 41 accepts the male portion of upper bracket 32, and the two threaded members 71 extending from the upper bracket 42 are "deadloaded" within the upwardly-directed slots defined by corresponding brackets 70. A limiting clip 90 may be installed on each number 71 if desired at this point. Thereafter, flat washer 77 and threaded nut 72 are installed and secured in place.

In the installation of panel member 60, it may be noted that some clearance is required in order to pivot the member 60 into place without interfering with header 14. The configuration of the universal brackets 70 allows for the panel member 50 to be temporarily adjusted downwardly, such that the screws 74 "top out" in their respective slots 73, in order to provide room for the panel member 60 to be pivoted into place. This may be done prior to insertion of the glass panels. After the solid panels have been installed the glass panels may be installed, along with their associated seals. After the panel member 60 is pivoted into place, corresponding hardware 72, 77 (and 90, if desired) is positioned into place and the lower member 50 may then be upwardly adjusted to its desired position.

Operation of Bracket

Figure 12:
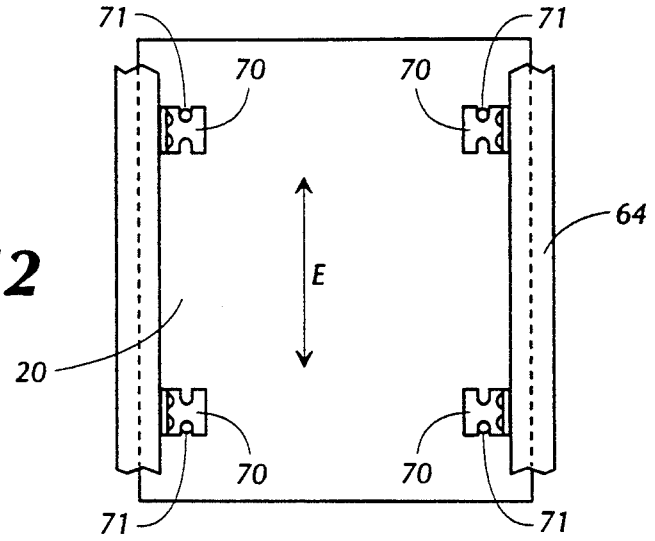
FIG. 12 is a side plan view of a panel member 20, illustrating how the panel member is attached to two typical mullion 64, shown only partially and in isolation.

Referring now to FIG. 12, a panel member such as 20 may be typically positioned on the outer surface of a commercial or other type building. It is not unusual for such elements to undergo what may be considered "thermal cycling", with the panel being subjected to often severe sunlight through a portion of a 24-hour day, but also being subject to a lesser, colder environment in that same 24-hour period. Therefore, as the panels undergo different thermal environments it is possible that they may expand or contract depending on their temperature. In instances where a panel may be quite long or high, it is not unusual for such panels to tend to expand and contract a significant distance during a 24-hour period. The present bracket according to the present invention contemplates such movement by expansion, and allows for it occur without damage to the attached panels.

The provision for vertical expansion of vertically-disposed panel members such as 20 is now discussed, although this discussion could apply as well to panels 30, 40, 50, and 60. As previously discussed, panel members such as 20 are attached to four brackets 70 by four machine screws 71, each of which fit within slots defined by the universal brackets 70. In one preferred configuration, the upper headed machine screws 71 are "deadloaded" within the two upper brackets 70 upon installation, which means that these screws carry the vast majority of the weight of the panel by simply resting atop a surface defining a portion of the slotted apertures in the brackets. Fastening hardware is then secured such that all the headed machine screws 71 are fixed to brackets 70. Preferably, the lower headed machine screws are positioned a distance away from the ends of their corresponding slots.

Should the panel expand vertically, it may be understood that the lowermost headed machine screw attachments may "break loose" relative to their corresponding fixed brackets, and slidably move downwardly within their corresponding elongate slot-shaped apertures. Conversely, if the panel contracts, the lowermost screws may slidably move upwardly within their slots.

In the above vertical expansion/contraction scenario, the lower screws 71 on a panel move within their slots while the upper screws 71 are stationary. It may be understood that, if the nuts on the lower screws are tightened to a sufficient degree, the upper screws could break loose and move upwardly due to panel expansion and downwardly due to vertical panel contraction. Preferably, the nuts 72 on the screws 71 are tightened until the lock washers 77 are flattened.

The provision for horizontal expansion of vertically-disposed panel members is now discussed, although this discussion could apply as well to panels 30, 40, 50 and 60. As previously discussed, square-headed machine screws 71 fit with a vertically-oriented elongate channel defined by brackets such as 21 or 22, and may slide relative to and along the extruded length of the channel 21 prior to securement. This allows the panel members such as 30, 40, 50, and 60 to be readily adjusted horizontally (or "side-to-side") prior to installation of a lock washer 77 and a nut 72 to fix the screws 71 to a bracket 70. However, it should be understood that the nut 72 in its final installed state is tightened in a manner so as to allow for an adequate connection between the head of the square-headed bolt or screw 71, but some movement is still allowed under conditions of horizontal expansion or contraction due to thermal cycling. As may be understood, some vertical expansion of the brackets such as 21, 22, 31, 32, etc., is possible, as these members are attached (thus allowing heat transfer) to corresponding solid panel members which may encounter varying thermal conditions as described above. Such horizontal expansion or contraction of the brackets such as 21, 22, 31, 32, etc., will be accommodated by the square head-channel relationship described above; eventually a head of a bolt 71 will "break loose" and allow the channel enclosing the nut to move relative to the nut. The lock washer in place will preferably maintain sufficient spring force to provide an adequate connection and discourage loosening of the associated threaded nut 72.

Therefore, it may be seen that the present invention provides a bracket which allows for expansion of panels, as well as an improved method for installing such panels, which may be facilitated by those having a minimal degree of skill.

Alternatives

As may be seen in reference to FIGS. 14–18, alternative bracket configurations are contemplated under the present invention.

Alternate Compositions

Any of the brackets such as described a 70 in this application may be composed of extruded aluminum, die cast Aluminum, or high strength plastic.

The planar panels my include an aluminum honeycomb interior as known in the art, may be hollow, or may be solid.

While this invention has been described in specific detail with reference to the disclosed embodiments, it will be understood that many variations and modifications may be effected within the spirit and scope of the invention as described in the appended claims.

What is claimed is:

1. A method of attaching planar members being capable of expansion to a vertical frame member, comprising the steps of:

attaching an upper and a lower bracket to said frame member such that said upper bracket is positioned above said lower bracket, said upper bracket having an open-ended, upwardly-directed slot-shaped aperture, and said lower bracket including a slot-shaped aperture;

positioning a planar member, having an upper and a lower elongate fastener extending therefrom, relative to said frame member such that said lower fastener is positioned within said slot of said lower bracket and said upper fastener is introduced through said open end of said upwardly-directed slot-shaped aperture and is subsequently positioned within said aperture of said upper bracket and said planar member is supported by resting said upper fastener on an upwardly-disposed surface defining a portion of said aperture;

fastening said upper and lower fasteners relative to said upper and lower brackets, respectively, such that said upper fastener is fixed relative to said upper bracket, and such that said lower fastener is fixed relative to said lower bracket so that said lower fastener may slide along and within the length of said elongate slot, but is restricted from moving substantially in a horizontal direction.

2. The method as claimed in claim 1, wherein said lower elongate fastener is a threaded member, and wherein a flat washer and a threaded nut are attached to said threaded member during attachment of said lower threaded member such that a portion of said lower bracket is captured between said washer and said planar member but said washer and said planar member may still slide relative to said lower bracket portion upon thermal expansion.

3. A method of attaching at least two interlocking planar members to a vertical frame member positioned under a header, comprising the steps of:

positioning upper, middle, and lower brackets adjacent to said vertical frame member, said upper bracket defining an aperture, and said middle and lower brackets each defining vertically elongate slot-shaped apertures therein to allow for their vertical adjustability relative to said frame member;

fastening said upper, middle, and lower brackets to said frame member by corresponding upper, middle, and lower fasteners extending through corresponding apertures;

attaching a lower planar member to said middle and lower brackets, said lower members including an upwardly-directed male member at its upper edge;

assuring said upper fastener is sufficiently tightened relative to said vertical frame member to allow said upper bracket to support at least a portion of the weight of an upper planar member;

installing said upper planar member, including a downwardly-disposed female member at its lower edge, to said upper bracket such that said female member partially accepts said male member of said lower planar member;

assuring said middle and lower fasteners are sufficiently loose to allow for upward relative movement between said middle and lower brackets and said vertical frame member;

urging said lower planar member upwardly such that said female member further accepts said male member and said middle and lower brackets are slidably adjusted upwardly relative to said vertical frame member due to the presence of said vertically elongate slot-shaped apertures; and tightening said middle and lower fasteners to secure said middle and lower brackets relative to said frame member.

* * * * *